United States Patent [19]

Costales et al.

[11] 4,060,969

[45] Dec. 6, 1977

[54] FLYER FOR TWISTING MECHANISMS

[76] Inventors: Manuel Costales; Moustafa I. Hakki, both of P.O. Box 884, Belmont, N.C. 28012

[21] Appl. No.: 691,862

[22] Filed: June 1, 1976

[51] Int. Cl.[2] ..... D01H 1/24; D01H 7/24; D01H 7/40

[52] U.S. Cl. ..... 57/102; 57/67; 57/111; 57/117; 57/156

[58] Field of Search ..... 57/67, 68, 70, 71, 102, 57/105, 109, 111, 115–118, 156

[56] References Cited

U.S. PATENT DOCUMENTS

| | | | |
|---|---|---|---|
| 37,702 | 2/1863 | Pearl | 57/115 |
| 432,856 | 7/1890 | Boelsterli | 57/67 |
| 1,117,940 | 11/1914 | Boyd | 57/70 |
| 1,574,689 | 2/1926 | Prince-Smith et al. | 57/115 X |
| 2,180,792 | 11/1939 | Casablancas | 57/67 |
| 2,995,003 | 8/1961 | Geen | 57/115 X |
| 3,421,306 | 1/1969 | Herubel | 57/71 |

*Primary Examiner*—John Petrakes
*Attorney, Agent, or Firm*—Wendell Coffee

[57] ABSTRACT

A free, rotating flyer is suspended from an arm hinged to the threadboard of a frame. The flyer is detachably connected to a flange which is positively driven by a timing belt. The flange coaxially surrounds the spindle.

29 Claims, 5 Drawing Figures

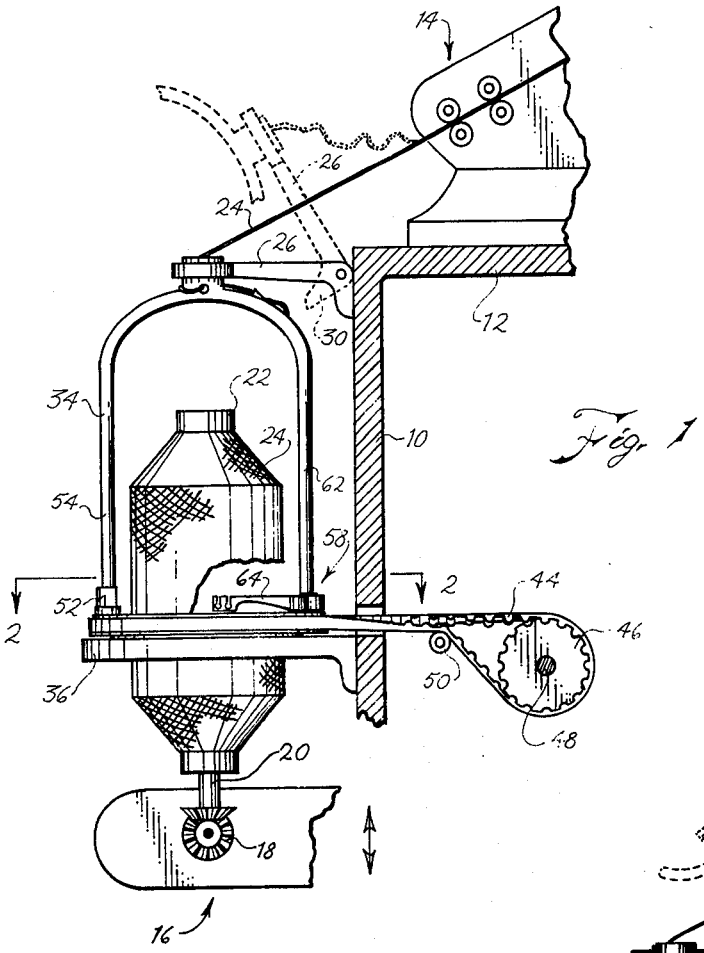
Fig. 1
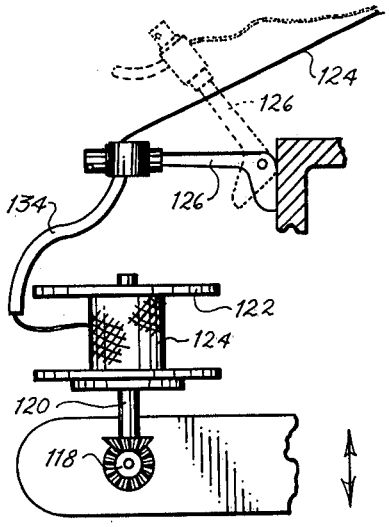
Fig. 5
Fig. 2
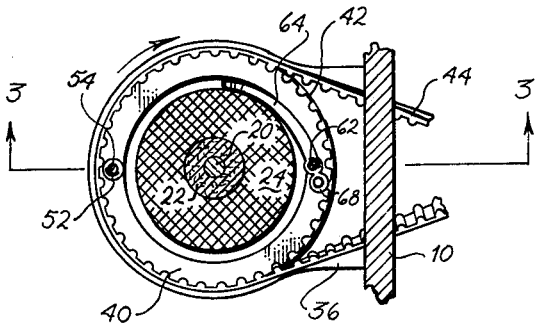

FLYER FOR TWISTING MECHANISMS

BACKGROUND OF THE INVENTION

1. Field of the Invention

This invention relates to textile machines that use flyers to insert twist to textile fibers, such machines being commonly called "roving frames."

2. Description of the Prior Art

Knowledgeable workers in the art realize that the two legs of the flyers presently commercially used tend to deflect and separate due to centrifugal force as the flyer is rotated (by the spindle) to insert twist to the roving. This deflection causes problems limiting the speed and hence the productivity of the roving frames.

Previous workers extended the legs long enough to circumvent the roving bobbin and attached both legs together at the bottom, thus improving the situation slightly.

At the time if filing this application, we were aware of the following U.S. Pat. Nos.:

Casablancas, 2,180,792; Friesen, 3,570,234; Mackie, 3,264,998.

SUMMARY OF THE INVENTION

New and Different Function

A light weight flyer that is free to rotate about a bearing is attached to a swing arm pivoted to the machine threadboard. The flyer is rotated by engagement to a positively driven flange which is driven by a timing belt. A presser is attached to the flange to supply tension and to guide the material to the bobbin. The flange is attached to the machine by a bearing on a base plate. The bobbin moves up and down by conventional building mechanism.

Both legs of the flyer are engaged to the rotating flange by guides in such a way as to prevent them from deflecting outward by centrifugal force. This construction allows the flyer to be manufactured of lighter material with smaller cross-section, thus reducing the centrifugal force. Therefore, with the lighter flyer and reduced forces, it becomes possible in some cases to eliminate one leg of the flyer. In other cases, it is possible to rotate the flyer by the pull of the material being twisted from the surface of the bobbin, thus eliminating the drive for the flange. The use of the presser is optional.

The swing arm allows the machine to be doffed without the need of bringing the frame to a certain doffing position; this also facilitates threading.

Objects of the Invention

An object of this invention is to insert twist to material.

Another object is to provide a simplified drive to a flyer that can be used on existing machines as well as new machines.

Other objects are to reduce power consumption, increase speed of production, reduce noise and facilitate doffing and threading.

Further objects are to achieve the above with a device that is sturdy, compact, durable, lightweight, simple, safe, efficient, versatile, and reliable, yet inexpensive and easy to manufacture, install, adjust, operate, and maintain.

Other objects are to achieve the above with a method that is versatile, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not to the same scale.

BRIEF DESCRIPTION OF THE DRAWING

FIG. 1 is a side elevational view of a spindle with an embodiment of our invention thereof, the roving machine being shown partially and sectionally.

FIG. 2 is a top sectional view taken substantially on line 2—2 of FIG. 1.

FIG. 5 is a side elevational view similar to FIG. 1 of a modification.

DESCRIPTION OF THE PREFERRED EMBODIMENTS

Figure 4:
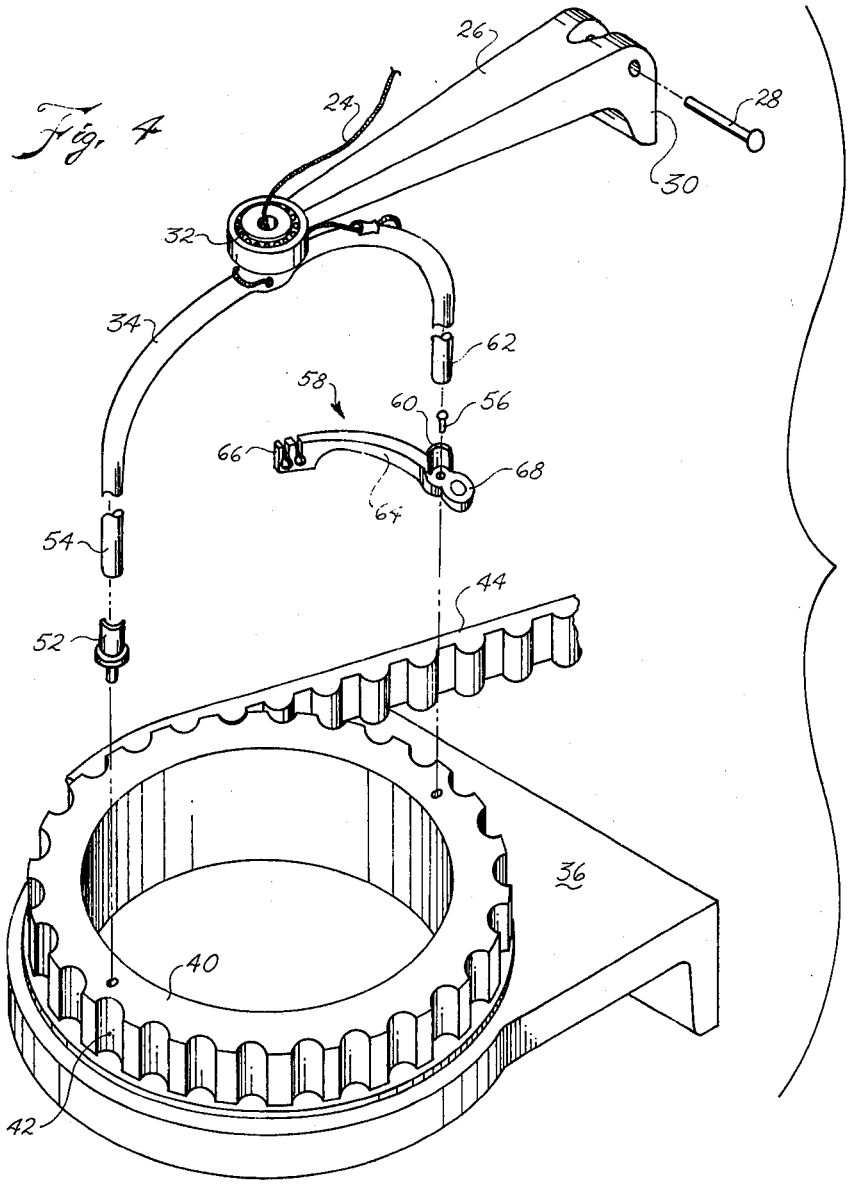
FIG. 4 is an exploded perspective view of an embodiment of the embodiment shown in FIG. 1.
Figure 3:
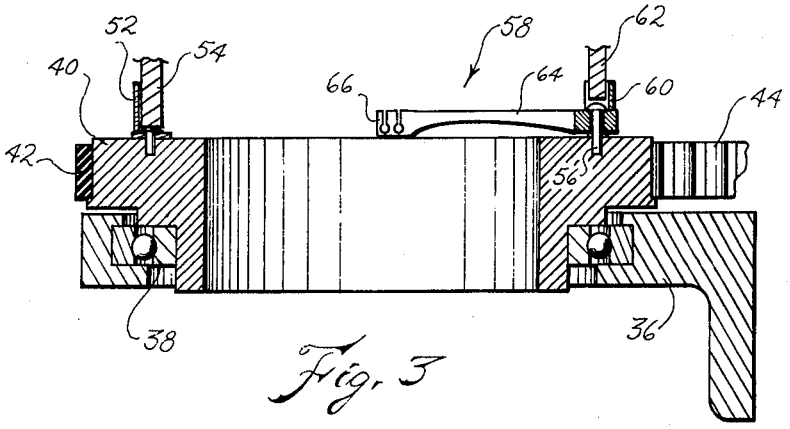
FIG. 3 is a partial axial sectional view taken substantially on line 3—3 of FIG. 2 with the spindle not shown.

Referring to FIG. 1 of the drawing, there may be seen illustrated a conventional machine to twist material or a roving frame. I.e., the roving frame has frame 10. The top part of the frame is called threadboard 12. Delivery rolls 14 are mounted on the threadboard. Carriage 16 is mounted for vertical reciprocation upon the frame 10 and has gears 18 for rotating spindle 20. Thus it may be seen that the carriage is a means for interconnecting the spindle and the flyer for vertical reciprocation through the frame. Bobbin 22 is mounted on the spindle of a roving machine which is a machine wherein the material used is textile fibers. Roving 24 is wound on the bobbin 22. Several spindles, etc., are mounted on each frame. Those having ordinary skill in the art will recognize that the equipment described above is conventional and commonly in commercial use today.

Swing arm 26 is attached to the frame at the threadboard 12. (FIGS. 1 and 4). The arm is attached by pin 28 through an ear on the threadboard. Heel 30 on the arm 26 stops the downward movement of the swing arm 26 so that the axis of bearing 32 in the end of the swing arm is in alignment with the axis of the spindle 20. I.e., the spindle 20 and the bearing 32 are coaxial.

Flyer 34 is biforcated and the hollow top of the flyer is journaled in bearing 32 so that the flyer is coaxial with the spindle 20. Except as being lightweight and smaller in cross section as mentioned above, basically, the flyer 34 is conventional and performs the same function as conventional flyers.

Base plate 36 is attached as by bolting to the side of the frame 10. The base plate has a circular opening therein which is concentric with the bobbin 22 and which surrounds the bobbin in the normal operating position. Main bearing 38 is located in the circular opening of the base plate 36. Flange 40 is journaled in the main bearing and, therefore, the flange 40, which is circular, is coaxial with the spindle 20 and the flyer 34. Rim 42 of the flange 40 is machined with teeth to mate with timing belt 44.

The timing belt is driven by pulley 46 attached to shaft 48. Those skilled in the art will understand that there is a plurality of delivery rolls and spindles upon the roving frame. The shaft 48 runs horizontally of the length of the machine and through a plurality of pulleys 46 which drives each of the flanges 40. The shaft 48 is geared to the same drive source as the gear 18 which drives the spindle 20; therefore, it may be seen that there is a predetermined speed ratio between the two. Idler 50, conveniently journaled to the frame 10, is used to guide the timing belt 44.

Catcher 52 is mounted upon the top surface of the flange 40. As seen, the catcher has an upward projecting back and side lip. When in use, as readily seen in FIGS. 1 and 2, leg 54 of the flyer 34 is engaged by the catcher lips. It may be seen that the outside lip prevents centrifugal forces from spreading the flyer leg while the rear portion of the catcher 52 rotates the flyer 34.

Presser pin 56 is 180° displaced from the catcher 52 on the top of th flange 40. I.e., the presser pin 56 is diametrically opposed to the catcher 52. Presser 58 is pivoted to the presser pin 56. It wil be noted that the presser, therefore, is pivoted for horizontal rotation. I.e., it rotates about the presser pin 56 which is parallel to the axis of the spindle 20.

The presser 58 has driving dog 60 on the top which has an arcuate innersurface coaxial with the presser pin 56. Like the catcher 52, it also has a drive surface and a side surface so that leg 62 may be both driven and restrained from centrifugal distortion thereby.

The presser has finger 64 which extends to presser tip 66 which presses against the roving 24 wound upon the bobbin 22. Counterweight 68 on the presser is responsive to centrifugal force to press the tip against the roving as seen in the drawing.

Operation

It will be understood that the bobbin 22 is rotated and reciprocates up and down by conventional drive means. When an end breaks, the frame stops automatically as is conventional. To piece-up, there is no need to bring the flyer 34 to a specified position as is required by present machines. It is possible to piece-up in any position because the flyer may be lifted up by the swing arm 26. The lifting operation disengages the flyer 34 from the driving dog 60 and the catcher 52. Then the broken end of the roving 24 is threaded through one leg of the flyer which is positioned at the easiest threading position by rotating it by hand while in the uptilted position. The flyer is lowered to operating or drive position. The flyer 24 is rotated back by hand to firmly engage the catcher 52 and the driving dog 60. The loose end of the roving 24 is spliced with the fibers emerging from the delivery roll 14; thereafter, the bobbin 22 is rotated by hand, forward, to take up any slack roving as is conventional. After the completion of these simple operations, the frame is ready to be started again. Those skilled in the art will recognize that piecing up procedure with our invention is simpler because is no need to position all the flyers every time one end is broken; also, they will understand that doffing is simpler with our invention.

With certain materials, such as continuous filament, a simplified version of our invention is applicable. Referring to FIG. 5, a double flange bobbin 122 mounted upon spindle 120 which is driven by conventional gearing 118. Yarn 124 is threaded through the flyer 134 which is illustrated with only one leg, although a flyer with two legs could be used. The flyer, as before, is journaled to a bearing within swing arm 126.

When running, the yarn 124, or other material to be twisted, pulls the flyer 134 as it is wound around the surface of the bobbin 122 through the driving mechanism 118.

Another variation would be to keep the bobbin and spindle in a nonreciprocating position and attach the flyer through the swing arm to a vertical reciprocating carriage. Another possible variation is to drive the flyer from the top, but still restrain the legs of the flyer from centrifugal reflection by by the rotating flange.

As an aid to correlating the terms of the claims to the exemplary drawing, the following catalog of elements is provided:

| | |
|---|---|
| 10 frame | 46 pulley |
| 12 threadboard | 48 shaft |
| 14 delivery rolls | 50 idler |
| 16 carriage | 52 catcher |
| 18 gear | 54 leg (in catcher) |
| 20 spindle | 56 presser pin |
| 22 bobbin | 58 presser |
| 24 roving | 60 driving dog |
| 26 swing arm | 62 leg (in presser) |
| 28 pin | 64 finger |
| 30 heel | 66 tip |
| 32 bearing | 68 counterweight |
| 34 flyer | 118 gear |
| 36 base plate | 120 spindle |
| 38 main bearing | 122 bobbin |
| 40 flange | 124 roving |
| 42 rim | 126 swing arm |
| 44 timing belt | 134 flyer |

The embodiments shown and described above are only exemplary. We do not claim to have invented all the parts, elements or steps described. Various modifications can be made in the construction, material, arrangement, and operation, and still be within the scope of our invention. The limits of the invention and the bounds of the patent protection are measured by and defined in the following claims. The restrictive description and drawing of the specific examples above do not point out what an infringement of this patent would be, but are to enable the reader to make and use the invention.

Subject matter claimed for protection:

1. In a machine to twist material having a. a frame, b. delivery rolls on the frame, c. a spindle mounted for rotation about its axis, d. a bobbin on the spindle, a flyer having legs mounted for rotation coaxially with the spindle, f. carriage means interconnecting the flyer and spindle through the frame for causing relative axial movement between the flyer and spindle, and g. said flyer being means for conducting the material from the delivery rolls to the bobbin, h. the improved method of operation comprising the steps of:

j. preventing deflection of the legs of the flyer by k. connecting them to a flange surrounding the bobbin, m. journaling the flange to the frame by a base plate, n. rotatably driving the flange, and thus o. rotating the flyer.

2. The invention as defined in claim 1 wherein the flange is rotated by a drive from the frame which is timed to the spindle rotation.

3. The invention as defined in claim 1 wherein a required operation of doffing or piece-up is accomplished by p. moving the flyer up and away from the flange, q. performing the required operation while the flyer is away from the flange, and thereafter r. reconnecting the flyer to the flange.

4. In a machine to twist material having
a. a frame,
b. delivery rolls on the frame,
c. a spindle mounted for rotation about its axis,
d. a bobbin on the spindle,
e. a flyer mounted for rotation coaxially with the spindle,
f. carriage means interconnecting the flyer and spindle through the frame for causing relative axial movement between the flyer and spindle, and
g. said flyer being means for conducting the material from the delivery rolls to the bobbin,
h. the improved structure comprising in combination:
j. a flange coaxially surrounding the bobbin,
k. the flange connected to the flyer,
m. a base plate attached to the frame,
n. a main bearing on the base plate,
o. said flange journaled to the main bearing.

5. The invention as defined in claim 4 with an additional limitation of
m. spindle drive means interconnecting the frame and spindle for rotating the spindle.

6. The invention as defined in claim 4 with additional limitations of
m. an arm mounted for movement to the frame,
n. a flyer bearing on the arm,
o. said flyer journaled to the flyer bearing.

7. The invention as defined in claim 6 wherein the arm is mounted for movement to the frame by
p. a pivot connecting the arm to the frame.

8. The invention as defined in claim 4 with an additional limitation of
m. flange and flyer drive means from the frame for driving the flange and flyer.

9. The invention as defined in claim 8 wherein the flange and flyer drive means drives the flange and the flyer is driven from the flange.

10. The invention as defined in claim 9 wherein the flange drive means includes
n. a timing belt meshed with timing teeth on the flange.

11. The invention as defined in claim 9 with additional limitations of
n. a plurality of delivery rolls, spindles, flanges and flyers on the machine,
o. a horizontal shaft extending the length of the machine,
p. a pulley on the shaft for each flange, and
g. a timing belt from each flange to its pulley, thus forming a portion of said flange drive means.

12. The invention as defined in claim 9 wherein the flyer drive means includes
n. a catcher on the flange engaging the flyer when the flyer is in the operating position.

13. The invention as defined in claim 12 with additional limitations of
o. a presser having a finger pivoted to the flange about an axis parallel to the spindle axis,
p. said presser finger riding on the material on the bobbin, and
q. said presser pivot and said catcher are spaced diametrically on said flange.

14. The invention as defined in claim 4 wherein the flange is detachably connected to the flyer by catcher means on the flange.

15. The invention as defined in claim 14 with an additional limitation of
p. flange and flyer drive means from the frame for driving the flange and flyer.

16. The invention as defined in claim 15 with an additional limitation of
q. spindle drive means interconnecting the frame and spindle for rotating the spindle.

17. The invention as defined in claim 16 wherein the flange and flyer drive means and the spindle drive means are interconnected.

18. The invention as defined in claim 17 wherein the flange and the flyer drive means drives the flange and the flyer is driven from the flange.

19. The invention as defined in claim 18 with additional limitations of
q. a presser having a finger pivoted to the flange about an axis parallel to the spindle axis,
r. said presser finger riding on the material on the bobbin.

20. The invention as defined in claim 19 wherein the flyer drive means includes
s. a catcher on the flange engaging the flyer when the flyer is in the operating position.

21. The invention as defined in claim 20 wherein said presser pivot and said catcher are spaced diametrically on said flange.

22. The invention as defined in claim 21 with additional limitations of
t. a plurality of delivery rolls, spindles, flanges and flyers on the machine,
u. a horizontal shaft extending the length of the machine,
v. a pulley on the shaft for each flange, and
w. a timing belt from each flange to its pulley, thus forming a portion of said flange drive means.

23. The invention as defined in claim 22 with additional limitations of
x. an arm mounted for movement to the frame,
y. a flyer bearing on the arm,
z. said flyer journaled to the flyer bearing.

24. The invention as defined in claim 23 wherein the arm is mounted for movement to the frame by
aa. a pivot connecting the arm to the frame.

25. In a machine to twist material having
a. a frame,
b. delivery rolls on the frame,
c. a spindle mounted for rotation about its axis,
d. a bobbin on the spindle,
e. spindle drive means interconnecting the frame and spindle for rotating the spindle,
f. a flyer mounted for rotation coaxially with the spindle,
g. carriage means interconnecting the flyer and spindle through the frame for causing relative axial movement between the flyer and spindle, and
h. said flyer being means for conducting the material from the delivery rolls to the bobbin,
j. the improved structure comprising in combination:
k. an arm pivoted to the frame,
m. a bearing on the arm,
n. said flyer journaled to said bearing, thus providing the aforedefined mounting for rotation,
p. a flange coaxially surrounding the bobbin,
q. the flange connected to the flyer,
r. a base plate attached to the frame, and
s. a main bearing on the base plate,
t. said flange journaled to the main bearing.

26. The invention as defined in claim 25 wherein the flange is detachably connected to the flyer by catcher means on the flange.

27. The invention as defined in claim 26 with additional limitations of u. a presser having a finger pivoted to the flange about an axis parallel to the spindle axis, v. said presser finger riding on the material on the bobbin.

28. The invention as defined in claim 27 wherein the flyer drive means includes w. a catcher on the flange engaging the flyer when the flyer is in the operating position.

29. The invention as defined in claim 28 wherein said presser pivot and said catcher are spaced diametrically on said flange.

* * * * *